United States Patent [19]

Smith

[11] Patent Number: 4,550,819

[45] Date of Patent: Nov. 5, 1985

[54] COIN APPARATUS

[75] Inventor: Barry L. Smith, Florissant, Mo.

[73] Assignee: UMC Industries, Inc., Stamford, Conn.

[21] Appl. No.: 422,956

[22] Filed: Sep. 24, 1982

[51] Int. Cl.[4] ..... G07F 1/04; G07F 5/08

[52] U.S. Cl. ..... 194/1 N; 194/1 K

[58] Field of Search ..... 194/1 L, 1 M, 1 N, 102, 194/9 R, 1 K

[56] References Cited

U.S. PATENT DOCUMENTS

| | | | |
|---|---|---|---|
| 2,237,132 | 4/1941 | Christensen | 194/1 K |
| 2,952,384 | 9/1960 | Holstein et al. | 221/104 |
| 2,991,867 | 7/1961 | Schuller | 194/18 |
| 2,993,581 | 7/1961 | Holstein et al. | 194/57 |
| 3,128,908 | 4/1964 | Holstein et al. | 221/105 |
| 3,929,212 | 12/1975 | Burzen | 194/1 L |
| 3,941,226 | 3/1976 | Drakes | 194/1 R |
| 4,037,701 | 7/1977 | Knickerbocker | 194/1 L |
| 4,412,607 | 11/1983 | Collins et al. | 194/1 N X |

*Primary Examiner*—F. J. Bartuska

*Attorney, Agent, or Firm*—Senniger, Powers, Leavitt and Roedel

[57] ABSTRACT

Coin apparatus for use in a manually operable vending machine which has latches for locking it against operation unless coin sufficient for purchase of an item is deposited, the apparatus having electronically controlled latch release members operable on manual operation of the vending machine, following deposit of a sufficient amount in nickels, dimes and quarters for a vend, to release the latches. The nickels, dimes and quarters drop through nickel, dime and quarter chutes, quarters being sensed by interception of a first beam of light, dimes by interception of a second beam of light, and nickels by interception of both beams. An escrow system includes a gate which opens on a vend to allow escrowed coins to drop out for delivery to a money box, provision being made for holding this gate open for a time sufficient for dropout of all escrowed coins.

11 Claims, 10 Drawing Figures

COIN APPARATUS

BACKGROUND OF THE INVENTION

This invention relates to coin apparatus, and more particularly to such apparatus for controlling the operation of a vending machine or the like.

The invention involves an improvement on the coin apparatus which has been supplied for many years by National Vendors Division of UMC Industries, Inc., St. Louis, Mo., assignee of this application, known as the ACMR coin mechanism, for controlling the operation of manually operated (as distinguished from electrically operated) vending machines such as cigarette machines. Reference may be made to U.S. Pat. Nos. 2,993,581, 2,991,867, 3,028,940, 3,149,709 and 4,036,347 relating to and showing the development of that mechanism. The last of these relates to a revision of the mechanism to extend its capacity up to $1.30 with a differential of 70 cents, for example, between the lowest and highest prices. This, however, has not gone far enough to take care of possible increase in prices of packages of cigarettes above $1.30. There are thousands of National Vendors manual cigarette vending machines now on location that may not be capable of vending at the prices such as will be required, and buyers of machines now want to be certain that they can be used to vend cigarettes at higher prices.

SUMMARY OF THE INVENTION

Accordingly, among the several objects of this invention may be noted the provision of improved coin apparatus practical for use in existing vending machines replacing their present ACMR coin mechanisms and in new vending machines to enable them to handle items at prices above $1.30 (and as high as $6.35, for example); the provision of coin apparatus having a nickel chute, a dime chute and a quarter chute and improved and simplified means for sensing passage of a nickel through the nickel chute, a dime through the dime chute and a quarter through the quarter chute; and the provision of coin apparatus having an improved system for escrowing coins either for return to a customer without a vend or for delivery on a vend to a money box, with assurance that all escrowed coins are allowed to drop out for delivery to the money box on a vend.

Coin apparatus of this invention is for use in a coin-controlled vending machine, e.g., a cigarette vending machine, which has first and second dispensing members manually operable by purchasers to obtain items of a first and a second price, respectively, and means for locking said members against operation to obtain any item comprising a first latch and a second latch. Each of the latches is movable between a locking position and a retracted position. The first latch normally occupies its locking position and the second normally occupies its retracted position, being movable to its locking position on operation of the second dispensing member. The coin apparatus controls the latches, comprising a first latch release member for releasing the first latch, a second latch release member for releasing the second latch, coin chute means for coins of different denominations, logic means for totalizing the value of coins passing through the chute means, means for storing data as to said first and second prices at which items are to be vended, and means controlled by the logic means for operating the first latch release member upon the totalized value reaching the first stored price and operation of a first dispensing member, and for operating both latch release members upon the totalized value reaching the second stored price and operation of a second dispensing member.

The chute means may comprise first, second and third chutes for coins of a first, a second and a third denomination (more particularly nickels, dimes and quarters), said chutes being located in side-by-side relation, first means for projecting a first beam of light across the first and third chutes, a first sensor for sensing said first beam, second means for projecting a second beam of light across the first and second chutes, and a second sensor for sensing said second beam. A coin of the first denomination passing through the first chute intercepts both beams to cause both sensors to signal the passage of a coin of the first denomination. A coin of the second denomination passing through the second chute intercepts the second beam to cause the second sensor to signal the passage of a coin of the second denomination. And a coin of the third denomination passing through the third chute intercepts the first beam to cause the first sensor to signal the passage of a coin of the third denomination.

The coin apparatus may have escrow means for escrowing coins deposited in the vendor for return to a customer or for delivery to a money box, said escrow means comprising a first gate and a second gate each having a closed position for holding coins in escrow pending coin return or a vend, coin return means operable by a customer for opening the first gate for dropout of escrowed coins to a coin return passage for return to the customer without opening the second gate, means operable on a vend for opening the second gate for dropout of escrowed coins to a money box passage for delivery of the coins to a money box without opening the first gate, said means operable on a vend comprising a control member movable away from and back to a retracted position on a vend, and means for holding the second gate open despite return of said control member to retracted position for a time sufficient for dropout of all escrowed coins and then releasing it for its return to closed position.

The stated chute and first and second beam and sensor arrangement and the stated escrow means may be useful in contexts other than that of the first and second latch release members, logic means and price data storage system referred to above.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
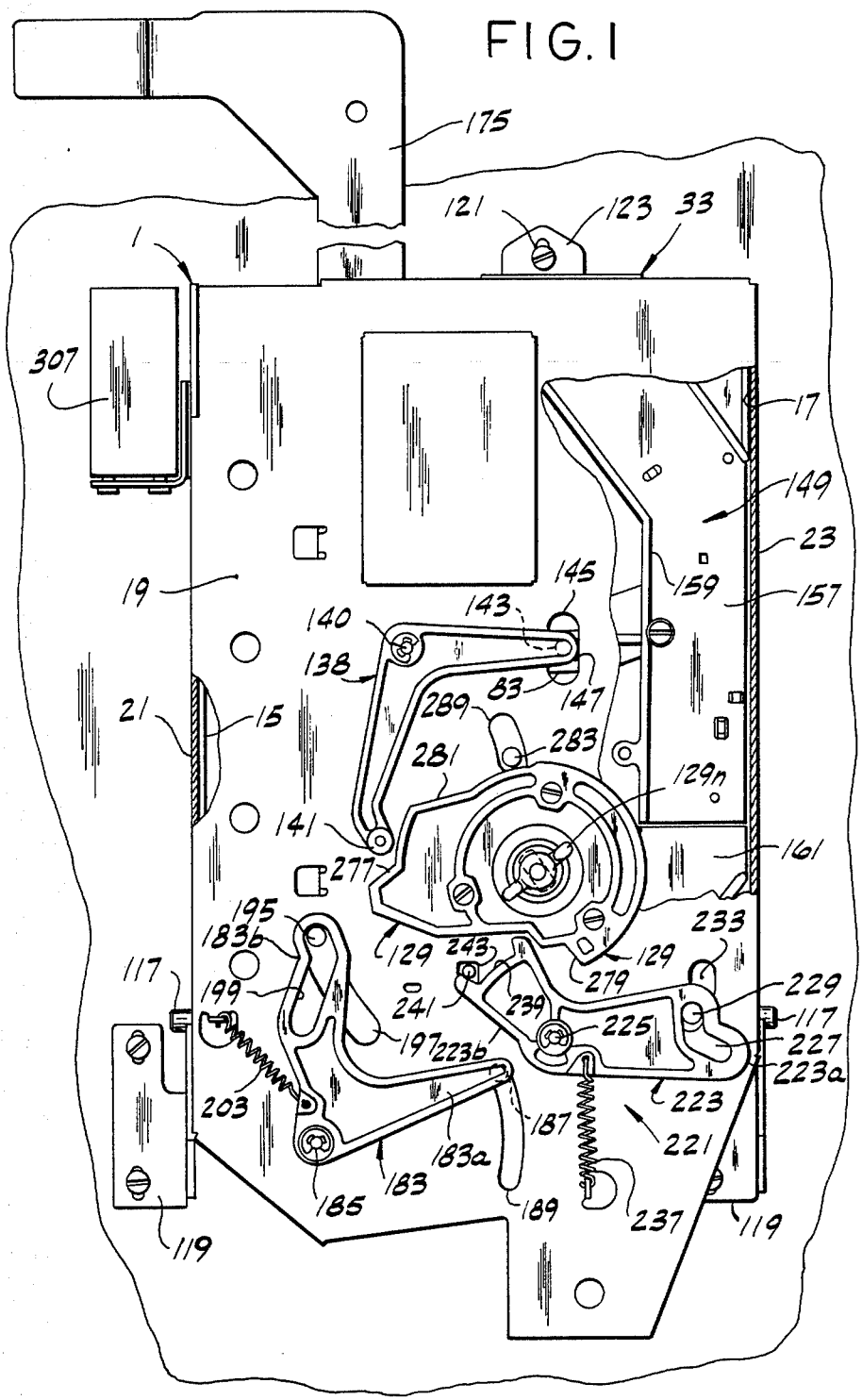
FIG. 1 is a view in front elevation of a coin apparatus of this invention, with parts borken away and shown in section.
Figure 2:
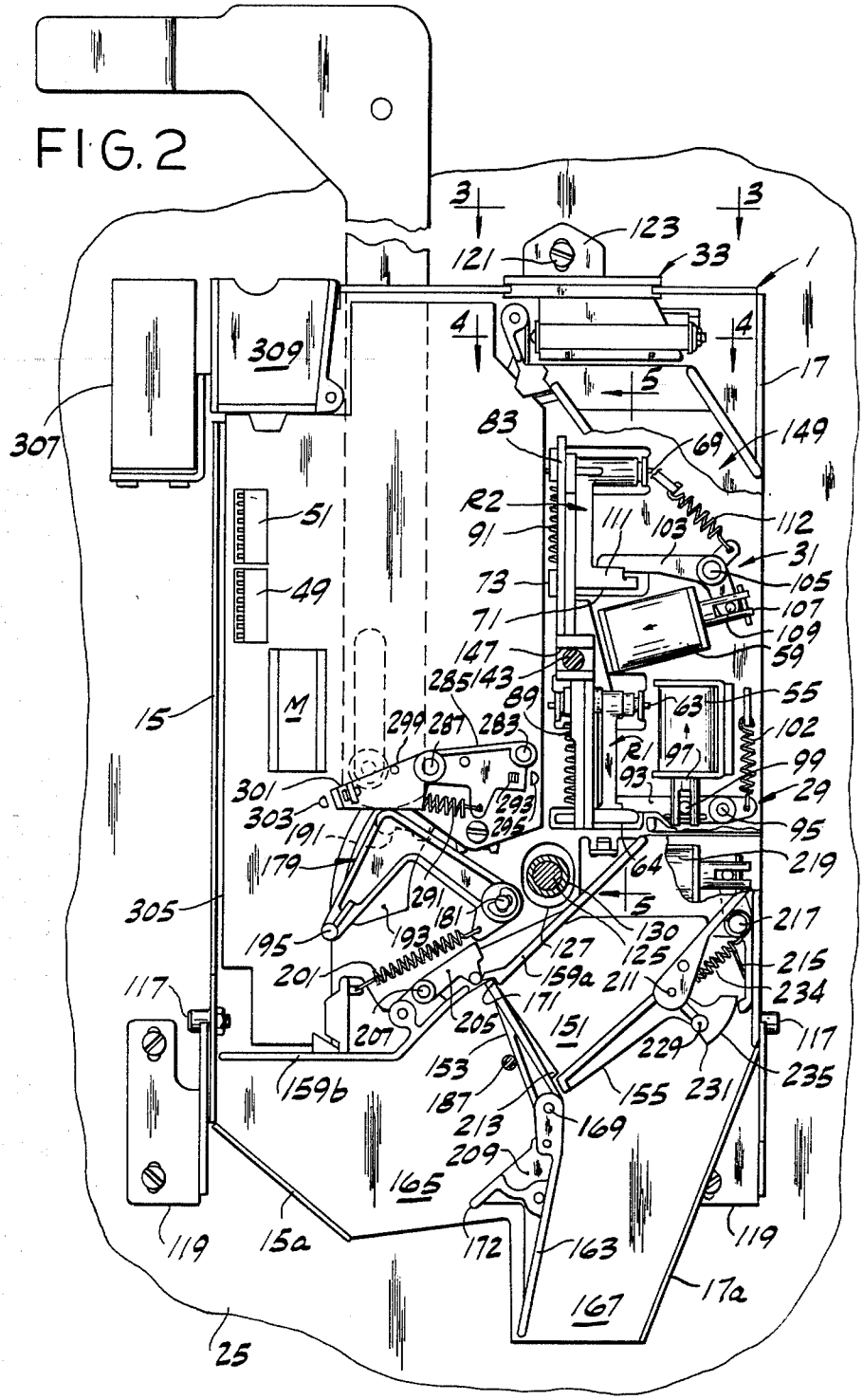
FIG. 2 is a view similar to FIG. 1 with a cover or front plate of the apparatus removed, and with parts broken away.
Figure 3:
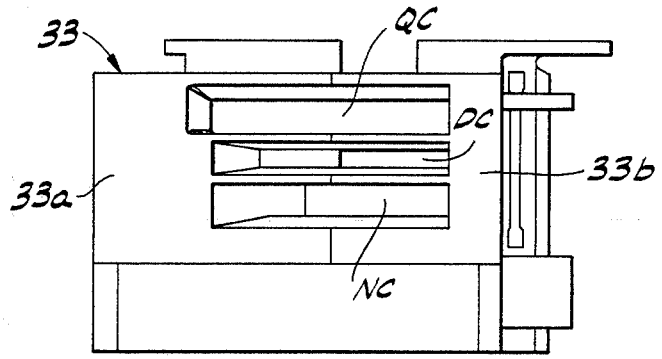
FIG. 3 is an enlarged view on line 3—3 of FIG. 2 showing the top of a coin chute assembly of the apparatus.
Figure 4:
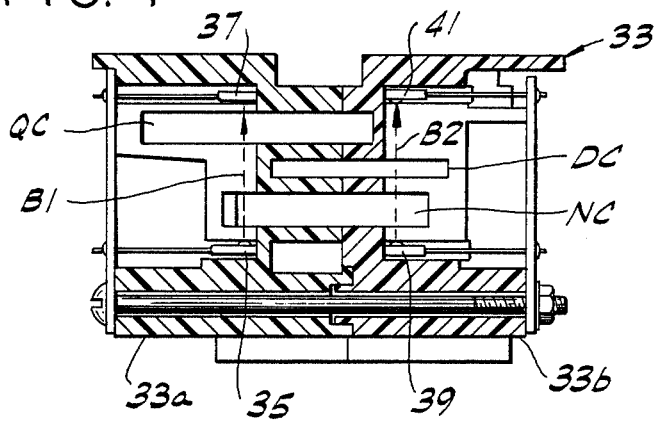
FIG. 4 is an enlarged horizontal section on line 4—4 of FIG. 2 showing a light beam coin sensor system associated with the coin chute assembly.

Referring to the drawings, a coin handling unit of this invention, designated in its entirely by the reference numeral 1 in FIGS. 1 and 2, is shown in the context of its use in a cigarette vending machine or vendor of the type illustrated in the coassigned U.S. Pat. No. 2,952,384 having an upper series of dispensing members constituted by ejectors for ejecting packs of cigarettes from magazines of an upper tier of magazines and a lower series of dispensing members constituted by ejectors for ejecting packs of cigarettes from magazines of a lower tier of magazines. These ejectors are indicated at E in said patent and in the drawings herein, each having a pull-out knob designated by the reference numeral 65. This machine is one that has been on the market for some years by National Vendors Division of UMC Industries, Inc. of St. Louis, Mo., referred to as National Vendors Model 222 Manual Cigarette Merchandiser. Each ejector E is adapted to be manually pulled out by a purchaser and then returned (pulled back inward) by spring means to obtain a pack of cigarettes upon deposit of an appropriate amount in coins (nickels, dimes, quarters) in the coin slot of the machine.

Figure 6:
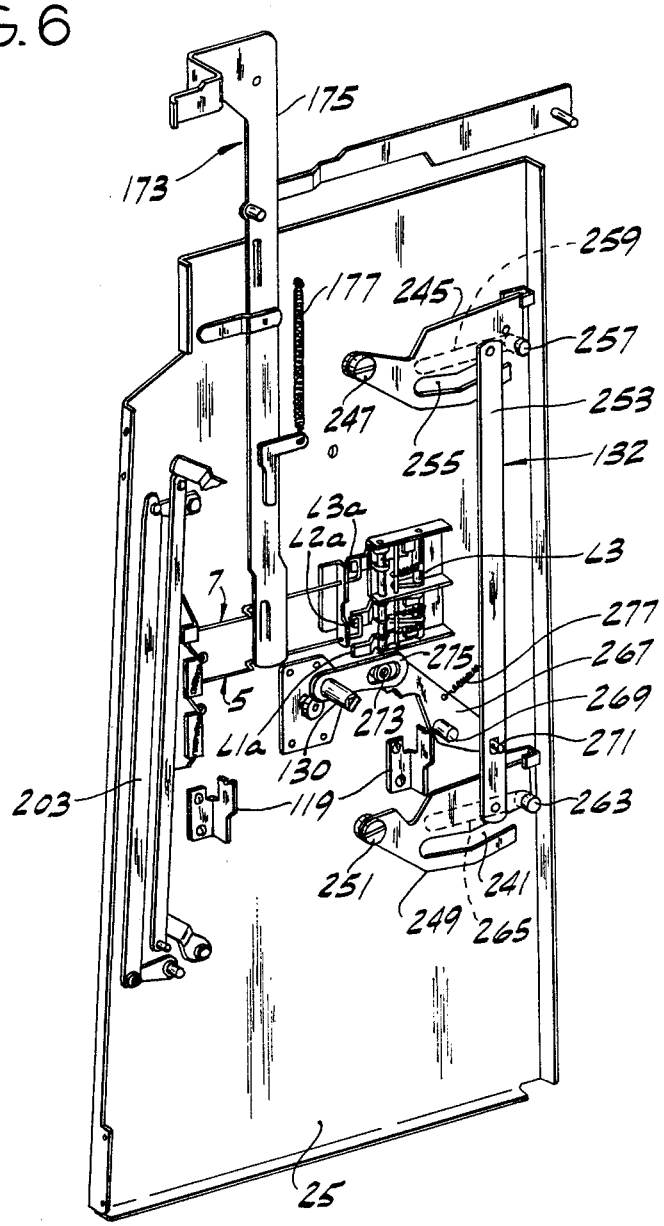
FIG. 6 is a perspective of the right side wall of the dispensing apparatus of a cigarette vending machine on which the coin handling unit shown in FIGS. 1 and 2 is mounted.
Figure 7:
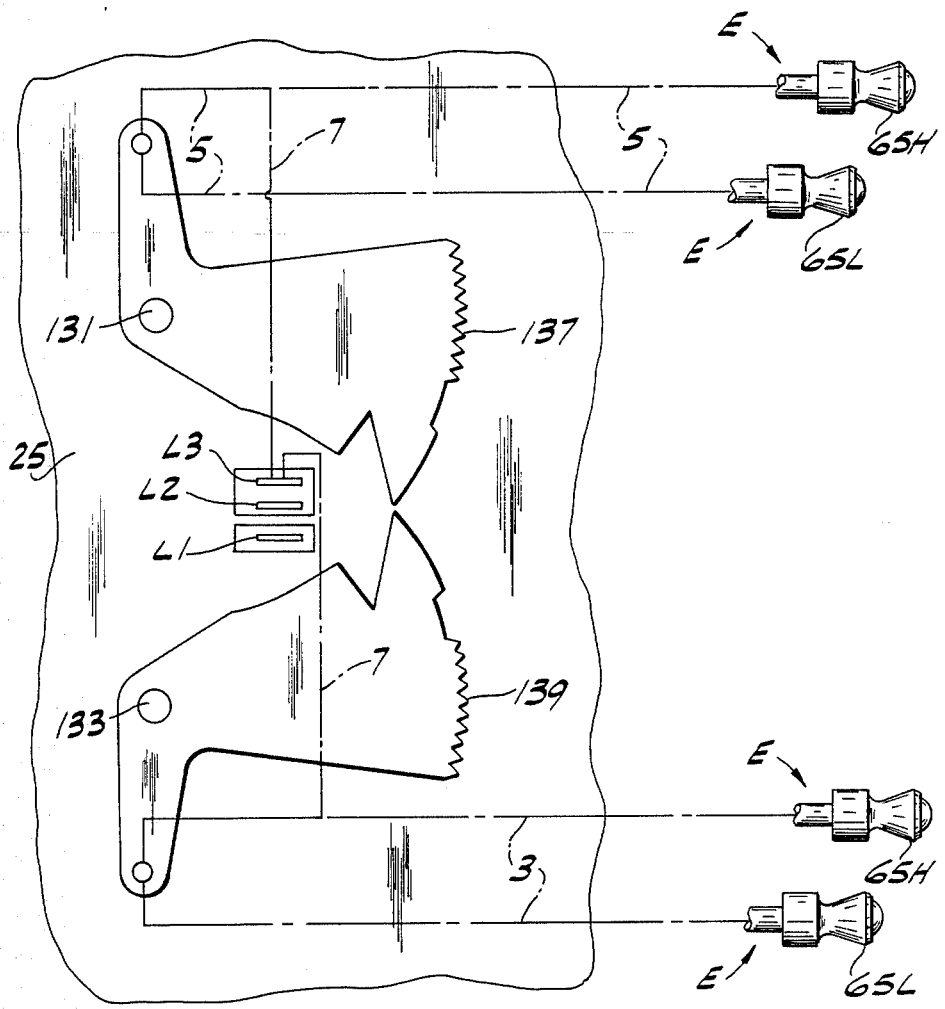
FIG. 7 is a semi-diagrammatic view showing high price and low price pull knobs of the vending machine and indicating how they actuate certain lockout levers, and how the high price knobs control a high price latch.

The machine has left and right side walls between which the tiers of magazines are located, the right side wall being indicated at 25 in said patent and shown herein and again indicated at 25. Also shown herein (in FIG. 7) are upper and lower lockout levers 137 and 139 corresponding to those indicated at 137 and 139 in said U.S. Pat. No. 2,952,384. These are located on the inside of wall 25 (its left side as viewed from the front of the machine), being mounted on rockshafts 131 and 133 corresponding to those indicated at 131 and 133 in said patent. The lockout levers are swingable toward a set of latches L1, L2 and L3 mounted on the right side wall 25, the arrangement being such that on pulling out any ejector, the upper or lower lockout member, as the case may be, is rotated to swing toward the latches and, with any one of the latches in its latching or locking position, the ejector is locked against being pulled out through a full stroke such as is required for a vend, and may be pulled out only a limited distance insufficient for a vend. The connections between the ejectors and the lockout levers are illustrated diagrammatically at 3 in FIG. 7. In the aforesaid Model 222 machine, packs of cigarettes may be vended at three different prices under control of the three latches L1, L2 and L3, L1 being what is referred to as the low price latch, L2 the medium price latch and L3 the high price latch. L1 normally occupies its latching or locking position; L2 and L3 normally occupy their retracted (unlocking) position. Each latch has a control lever, these being indicated at L1*a*, L2*a* and L3*a*, respectively, in FIGS. 5 and 6. Mechanism such as indicated at 5 in FIG. 6 is provided operable on pulling out an ejector for an item selling at the medium price to release latch L2 for movement to its locking position, and mechanism such as indicated generally at 7 in FIGS. 6 and 7 is provided operable on pulling out an ejector for an item selling at the high price to release latch L3 for movement to its locking position. Reference may be made to the aforesaid U.S. patents for full details.

Figure 5:
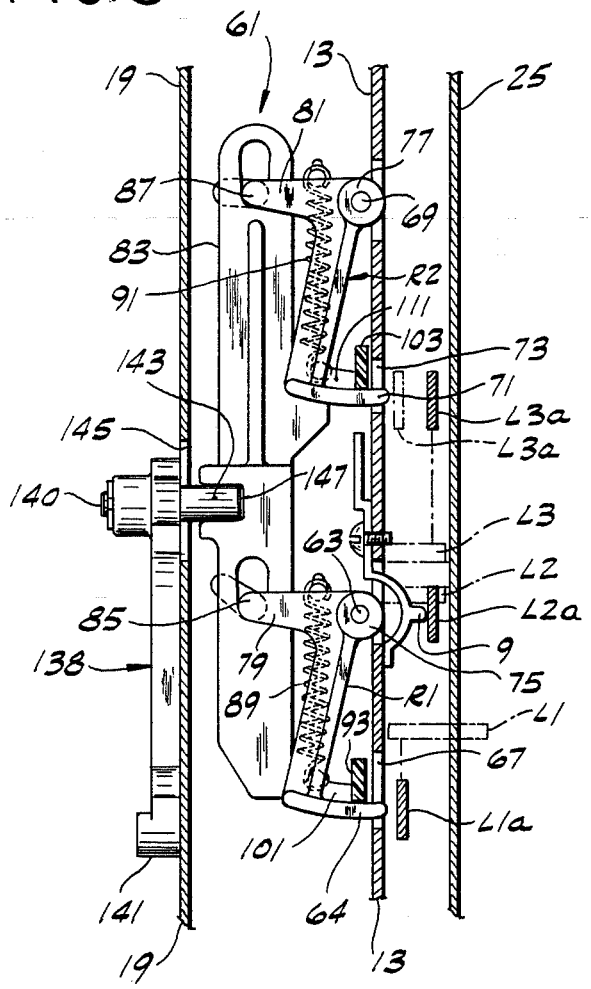
FIG. 5 is an enlarged vertical section on line 5—5 of FIG. 2.

The coin handling unit 1 of this invention, as herein illustrated, is for two-price operation only, instead of three, and accordingly has means indicated at 9 in FIG. 5 constituted by a lug at the back of the unit engageable with control lever L2*a* for latch L2 permanently to hold L2 in its retracted position, thereby rendering it inoperative. Thus, the machine with which unit 1 is used operates with latch L1 normally in locking position, L2 in retracted position as long as unit 1 is in place on side wall 25, and L3 normally in retracted position but moved into locking position on pulling out an ejector for an item selling at the high price. As illustrated in FIG. 7, a knob in each of the upper and lower series to be pulled out for vending a low price item is designated 65L, and a knob in each of the upper and lower series to be pulled out for vending a high price item is designated 65H. To enable a vend of an item selling at the low price, latch L1 must be retracted to enable full pull-out of a knob for the low price item. L3 remains in retracted position, and L2 is permanently in retracted position. To enable a vend of an item selling at the high price, both L1 and L3 must be retracted, L3 having moved to locking position on pulling out a knob (65H) for a high price item. The mechanism for effecting movement of latch L3 to its locking position or pulling out a high price knob 65H corresponds to the mechanism shown in U.S. Pat. No. 2,952,384 and others, including a high price shaft for each tier price arms on that shaft, and a link similar to that shown at 203 in said patent.

The coin handling unit 1 of this invention comprises a main mechanism plate or back plate 13 having left and right side flanges 15 and 17 and a front cover plate 19 having left and right side flanges 21 and 23 which fit on the outside of flanges 15 and 17. A first latch release member R1 operable on latch control lever L1*a* for releasing the latch L1 is mounted on the back plate 13 for movement away from the retracted position in which it is illustrated in FIG. 5 for releasing latch L1, and a second latch release member R2 is mounted on the back plate 13 above R1 for movement away from the retracted position in which it is illustrated in FIG. 5 to engage control lever L3*a* for releasing latch L3. As noted above, latch L2 is permanently held released by the lug 9 on the back plate. At 29 in FIG. 2 is indicated a first solenoid-operated means for holding the first latch release member R1 against latch-releasing movement, and at 31 is indicated a second solenoid-operated means for holding the second latch release member R2 against latch-releasing movement.

At 33 in FIGS. 1–4 is indicated a coin chute means comprising an assembly of two molded parts 33*a* and 33*b* formed to provide a nickel chute NC, a dime chute DC and a quarter chute QC through which travel nickels, dimes and quarters inserted in the coin slot of the vending machine in which the unit 1 is used. At 35 (see FIG. 4) is indicated first means, more particularly a light emitting diode (LED) for projecting a first beam of light B1 across the nickel and quarter chutes NC and QC, but not across the dime chute DC, and at 37 is indicated a first sensor for sensing this beam of light. At 39 is indicated second means also more particularly an LED for projecting a second beam of light B2 across the nickel and dime chutes NC and DC, but not across the quarter chute QC, and at 41 is indicated a second sensor for sensing this second beam of light. The chutes are located in side-by-side relation with the dime chute between the nickel chute and the quarter chute, and are so offset edgewise relative to each other at the level of of the beams as to provide for projecting the first beam B1 across the nickel and quarter chutes without intersecting the dime chute, and for projecting the second beam B2 across the nickel and dime chutes without intersecting the quarter chute. The arrangement is such that a nickel travelling in the nickel chute intercepts both beams B1 and B2 to cause the first and second sensors 37 and 41 jointly to signal the passage of a nickel, a dime travelling in the dime chute intercepts the second beam B2 to cause the second sensor 41 to signal the passage of a dime, and a quarter travelling in the quarter chute intercepts the first beam B1 to cause the first sensor 37 to signal the passage of a quarter.

The sensors 37 and 41 are interconnected with logic means constituted by a microcomputer M (see FIGS. 2 and 10) operable to totalize the value of coins travelling in the chutes NC, DC, QC thereby to arrive at the credit established by a purchaser for a purchase. Means is provided for storing information as to the two prices at which items are to be vended comprising a first binary switch means 49 for setting the lower of the two prices (the first price) and a second binary switch means 51 for setting the higher of the two prices (the second price). These two switch means are interconnected with the microcomputer M, which is operable to compare with the price the total amount credited with the prices which have been set. When the credit equals the first price, the microcomputer turns on a transistor 53 to energize solenoid 55 of the first solenoid-operated means 29. When the credit reaches the second price, the microcomputer turns on a transistor 57 to energize the solenoid 59 of the second solenoid-operated means 31. With the first solenoid 55 energized, the first latch-release member R1 is released to enable its movement away from its retracted position for releasing the first latch L1. With the second solenoid 59 energized, the second latch-release member R2 is released to enable its movement away from its retracted position for releasing the second latch L3. At 61 is generally indicated means operable on manual operation of a knob 65L for an item of the first price for moving the first latch release member R1, upon its release, away from its retracted position for releasing the first latch L1, and operable on manual operation of a knob 65H for an item of the second price for moving both latch release members R1 and R2, upon their release, away from their retracted position for releasing both latches L1 and L3.

The first latch release member R1 comprises a lever pivoted at 63 on the inside (front) of the back plate 13 of unit 1 extending down from the pivot and having a projection 64 in the form of a foot extending rearward at its lower end in register with a slot 67 in the back plate. The second latch release member R2 similarly comprises a lever pivoted at 69 on the inside of the back plate extending down from the pivot and having a projection 71 in the form of a foot extending rearward at its lower end in register with a slot 73 in the back plate. Each lever has a crank arm extending forward from its hub at its upper end, the hubs being designated 75 and 77 and the crank arms being designated 79 and 81 respectively. A yoke constituted by a elongate bar 83 is mounted for up and down movement on the crank arms 79 and 81 by means of pin and slot connections with the arms 79 and 81 at 85 and 87 and is connected to the arms 79 and 81 by coil tension springs 89 and 91, respectively. This yoke or bar 83 constitutes a single driving member for both the latch release members R1 and R2.

The first solenoid-operated means 29 (which controls the first latch release member R1) comprises in addition to the stated first solenoid 55 a lever 93 pivoted at 95 on the inside of the back plate 13, the plunger 97 of this solenoid being pin-connected to this lever at 99. The lever 93 has a free end portion adapted to extend in the path of a lug 101 on the foot 64 of latch release lever R1 (see FIG. 5). A spring 102 biases the lever 93 to swing conterclockwise as viewed in FIG. 2 into a holding position engaging the top of the foot 64 wherein the free end of the lever 93 is engaged by the lug 101 on the foot to latch member R1 in its retracted position of FIG. 5.

The second solenoid-operated means 31 (which controls the second latch release member R2) comprises in addition to the stated second solenoid 59 a lever 103 pivoted at 105 on the inside of the back plate 13, the plunger 107 of the solenoid 59 being pin-connected to this lever at 109. The lever 103 has a free end portion adapted to extend in the path of a lug 111 on the foot 71 of latch release lever R2 (see FIG. 5). A spring 112 biases the lever 103 to swing conterclockwise as viewed in FIG. 2 into a holding position engaging the top of the foot 71 wherein the free end of the lever is engaged by the lug 111 on the foot 71 to latch member R2 in its retracted position of FIG. 5.

The latches 93 and 103 are normally held down by springs 102 and 112 in their latching positions of FIGS. 2 and 5 wherein their free ends lie in back of and are engaged by the lugs 101 and 111 on the feet 64 and 71 of the two latch release members R1 and R2. The latter are thereby held in the retracted position in which they all illustrated in FIG. 5. The driving member or yoke 83 is held pulled up by the springs 89 and 91 in the raised position in which it is illustrated in FIGS. 2 and 5.

The coin handling unit 1 is detachably mounted on the outside of the wall 25 by means of pins 117 at the sides of the unit fitting in slotted brackets 119 on the wall, and a screw 121 extending through a screw hole in a tab 123 at the top of the unit threaded in a hole in the wall. A stub shaft 125 extends forward from the wall 25 through being accommodated in an opening at 127 in the back plate 13 and cover plate 19 of unit 1 as it is mounted on the wall. A cam 129, which may be broadly referred to as a control member, is removably secured as by a wing nut 129r to the outer end of a hub 130 rotatable on the stub shaft, enabling its removal from the hub for detachment of unit 1 from the wall 25. The cam is keyed to the hub and is adapted to be rotated clockwise through an angle of about 45° from its home position of FIG. 1 on pulling out any knob (e.g., 65L or 65H) of the vending machine via means indicated generally at 132 in FIG. 6, rotating back to its home position under a spring bias as will appear.

Among other functions, the cam 129 acts as it rotates away from its FIG. 1 home position to drive the driving member or yoke 83 down against the return bias of springs 89 and 91 from its raised retracted position of FIGS. 2 and 5 to a lowered position via a bell crank lever 138 pivoted at 140 on the outside (front) of the cover plate 19 of unit 1, this lever having a cam follower 141 at the end of one of its arms riding on the cam 129 and a pin 143 extending from the end of its other arm through a slot 145 in plate 19 into a transverse groove 147 in the yoke. The cam is so developed and phased that as it rotates clockwise as viewed in FIG. 1 from its home position, it swings the bell crank lever 138 clockwise as viewed in FIG. 1 to move the pin 143 down. Then, drive the yoke 83 down, and, as the cam rotates counterclockwise back to its home position, the yoke returns to its raised position under the bias of springs 89 and 91.

Having passed through the coin chute means 33, coins (nickels, dimes and quarters) drop through a chute 149 at the right side of the unit 1 into an escrow hopper indicated generally at 151 in FIG. 2 comprising a left-hand gate 153 which may be referred to as the coin return gate, and a right-hand gate 155, which may be referred to as the money box gate. The chute 149 is defined by plastic molding having a web portion 157 forming the back of the chute and a left-hand flange 159 forming the left edge of the chute, by the cover plate 19 forming the front of the chute, and by the right-hand flange 23 of the cover plate forming the right edge of the chute (see FIG. 1). The molding is so formed that the chute 149 has a lower section 161 (see FIG. 1) angling down and toward the left, this section opening into the hopper 151. The flange 159 of the molding has an angled portion **159*a* forming the upper edge of the angled chute section 161 and the hopper 151, and a continuation 159*b* from the lower end of portion 159*a* to the left side flange 15 of the plate 13. The latter has a lower end portion 15*a* angled downward and toward the right, and the right side flange 17 of the plate 3 has a lower end portion 17*a* angled downward and toward the left. A partition 163 secured to plate 3 divides the space between flange portions 15*a* and 17*a* into a coin return chute 165 (at the left) and a money box chute 167 (at the right). The coin return gate 153 is pivoted for swinging movement on a pin 169 at the upper end of the partition 163 and is swingable on this pivot between a closed position extending up and toward the left from the axis of the pin 169 determined by the engagement of the upper end of the gate with a shoulder 171 formed on the bottom of angled flange portion 159*a* at its lower end, and a fully open position determined by its engagement with an inclined lip 172 on the partition. The gate 153 is controlled by a customer-operated coin return mechanism indicated generally at 173 comprising a coin return bar 175 slidable up and down on wall 25, biased by a spring 177 upwardly to a raised retracted position and adapted to be moved downwardly (for coin return) by the customer pushing down a coin return knob (not shown) such as indicated at 19 in U.S. Pat. No. 2,952,384. The coin return bar 175 via a lever 179 pivoted at 181 on the back plate 13 (see FIG. 2) controls a lever 183 pivoted at 185 on the front of the cover plate 19. Lever 183 has an arm 183*a* having a pin 187 at its free end extending through an arcuate slot 189 in the cover plate engageable as appears in FIG. 2 with the bottom of the gate 153. Lever 179 has a lug 191 extending back through a slot 193 in the back plate 13 engageable by the lower end of the coin return bar 175, and a pin 195 at its free end extending forward through an arcuate slot 197 in the cover plate 19 as appears in FIG. 1 into a cam slot 199 in a second arm 183*b* of lever 183. Lever 179 is biased clockwise as viewed in FIG. 2 by a spring 201 to a raised retracted position determined by engagement of the lug 191 with the upper end of the slot 193, and lever 183 is biased counterclockwise by a spring 203 to a raised retracted position determined by engagement of the pin 195 with the upper end of cam slot 199 in arm 183*b* of lever 183. A latch 205 for latching the gate 153 in its closed position is pivoted at 207 on the flange continuation 159*b*. Partition 163 has a notch at 209 for accommodating the pin 187 when it swings down with lever 183 to a lowered position for allowing gate 153 to open under gravity bias tending to cause the gate to swing down, as results from the center of gravity of the gate being toward the left of the pivot 169**.

Figure 8:
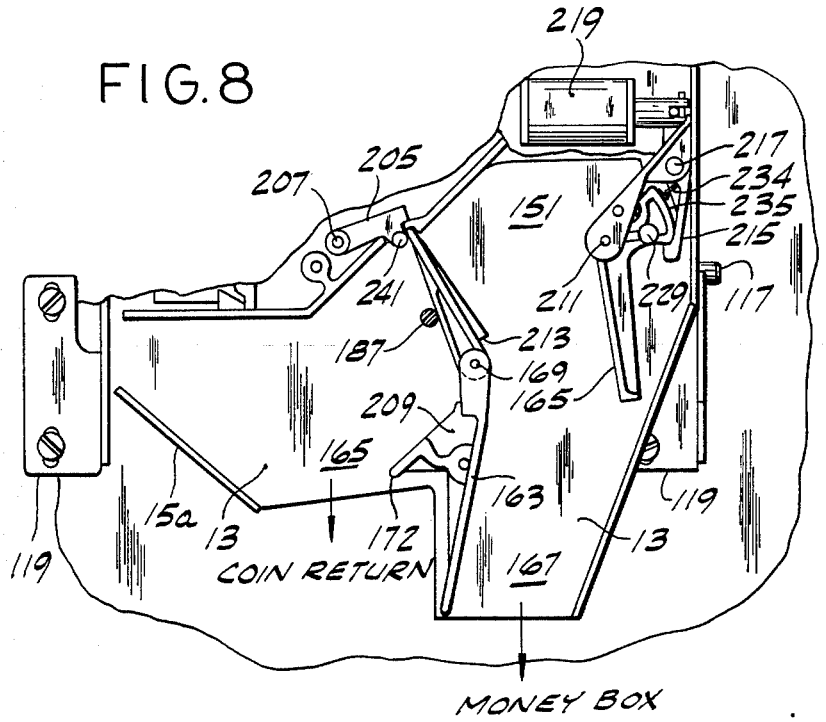
FIG. 8 is a fragment of FIG. 2 showing a money box gate open.
Figure 9:
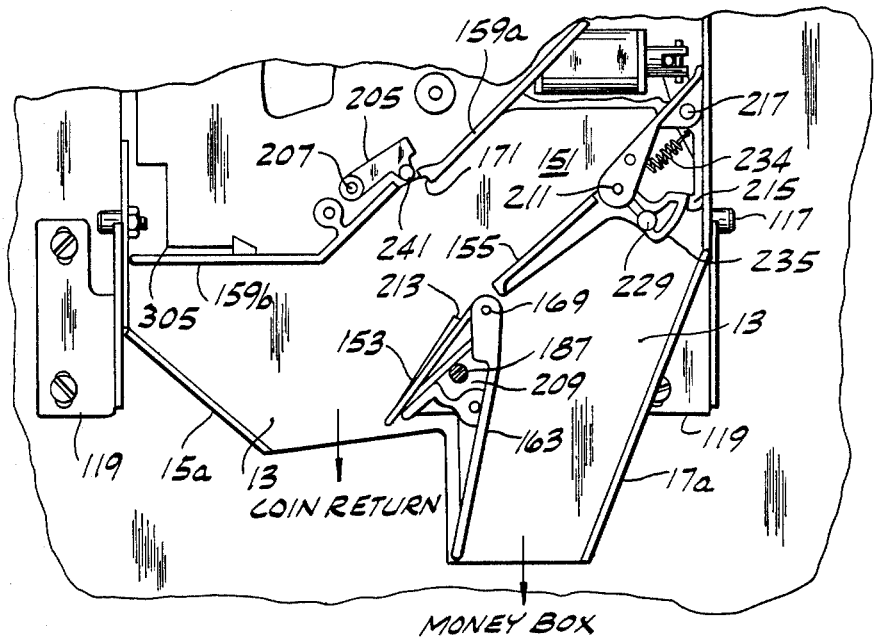
FIG. 9 is a similar fragment of FIG. 2 showing a coin return gate open.

The money box gate 155 is pivoted on a pin 211 at the lower right edge of the angled section of the chute 149 and is swingable on this pin between a closed position extending down and toward the left from the pin forming a V with the closed gate 153, engaging with a shoulder 213 on the gate 153, and an open position extending down and toward the right from the pivot pin with its lower end adjacent the inclined lower side flange portion **17*a*. The gate 155 is adapted to be latched in its open position by a latch 215 pivoted at 217 on the chute molding and operable by a solenoid 219. The gate 155 is controlled by mechanism indicated generally at 221 in FIG. 1 controlled by the aforesaid cam 129 and comprising a lever 223 pivoted at 225 on the front of cover plate 19 having an arm 223*a* with a cam slot 227 at its free end receiving a pin 229 extending forward from an arm 231 at the upper end of the gate 155 through an arcuate slot 233 in the cover plate. The arm 231 has a curved end 235 engageable by the latch 215, the latter being biased by a spring 234 to hook under the end of the arm to latch the gate in the open position in which it is shown in FIG. 8. Lever 223 is biased by a spring 237 to swing clockwise on its pivot 225 to the retracted position in which it is ahown in FIG. 1, and has a second arm 223*b* having a notch 239 at its free end receivng a pin 241 on the latch 205 for the coin return gate 153 for controlling this latch as will appear. The pin 241 extends forward from latch 205 through an opening 243 in the cover plate 19**.

Referring to FIG. 6 the cam-driving means 132 is shown to comprise an upper lever 245 pivoted at 247 and a lower lever 249 pivoted at 251 on wall 25 interconnected by a vertically extending link 253. The upper lever has a cam slot 255 receiving a pin 257 extending through an upper slot 259 in wall 25 and the lower lever has a cam slot 261 receiving a pin 263 extending through a lower slot 265 in the wall. The upper pin 257 is pulled forward by an upper drawbar (not shown) of the vending machine when any upper knob 65 is pulled out thereby to cam the upper lever 245 up to pull up the link 253. The lower pin 263 is pulled forward by a lower drawbar when any lower knob 65 is pulled out thereby to cam the lower lever 249 up to push up the link 253. A lever 267 pivoted at 269 on wall 25 is pin-connected at 271 to the link 253 and pin and slot connected at 273 to a crank 275 on the hub 130 for the cam 129. A spring 277 interconnected between wall 25 and the lever 267 biases the lever clockwise to swing the crank 275 and rotate the the hub counterclockwise to bring the cam to its home position of FIGS. 1 and 6. The arrangement is such that, on pulling out any knob 65, the cam 129 is rotated clockwise away from its home position through the aforesaid angle of about 45°, and then returned counterclockwise back to its home position as the knob returns to its retracted position.

Figure 10:
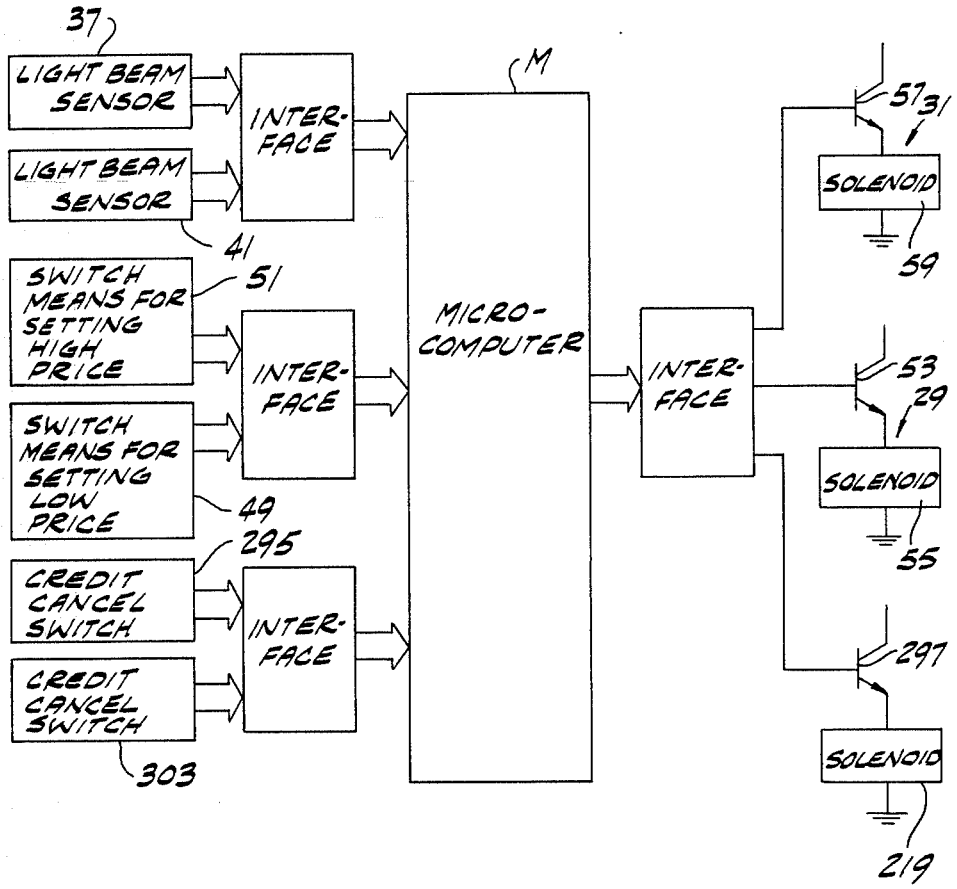
FIG. 10 is an electrical circuit diagram.

The cam 129 has a rise at 277 for follower 141 on lever 138, a rise at 279 for lever 223 and a rise at 281 for a pin 283 on a lever 285 pivoted at 287 on plate 13. Pin 283 extends forward from the lever 285 through an arcuate slot 289 in cover plate 19. Lever 285 is biased to swing clockwise for engagement of pin 283 with the cam by a spring 291. As is so the cam rotates clockwise from its home position of FIG. 1 through its forward stroke on pulling out a knob 65, its rise 277 swings lever 138 clockwise on its pivot 140 to drive down the yoke 83, its rise 279 swings lever 223 counterclockwise on its pivot 225 to an advanced position for opening the money box gate 155, an its rise 281 swings lever 285 counterclockwise on its pivot for a purpose that will appear. As the money box gate 155 opens, it becomes latched in its open position by the latch 215. Then, as the cam rotates counterclockwise through its return stroke back to its home position, bell crank lever 138 returns to its retracted position and the yoke 83 moves back up to its raised retracted position. Lever 285 also returns to its retracted position of FIG. 2. Lever 223, however, remains in its advanced position with the money box gate 155 latched open by the latch 215 until solenoid 219 is energized to release the latch 215. Lever 285 carries a magnet 293 controlling a Hall effect switch 295 interconnected with the microcomputer M as shown in FIG. 10. When the lever 285 is swung up by the cam 129 on a vend, switch 295 signals the microcomputer to erase the credit which had been established by the deposit of coins. As the vend is completed, lever 285 swings back down. This signals the microcomputer to time out a delay, at the end of which a transistor 297 is turned on to energize the solenoid 219 to release the latch 215. This releases the money box gate 155 and hence the lever 223 to allow the lever 223 to swing back from its advanced position to its retracted position of FIG. 1 under the bias of spring 237, cam 129 meanwhile having returned to its home position, thereby to swing the money box gate 155 back to its closed position. The time delay is sufficient (e.g., one-half second) to insure that all coins that may have been escrowed in the hopper 151 drop out to the money box. It will be observed that while the opening of the money box gate 155 is effected by the cam 129 via lever 223 on a vend (without, of course, opening the coin return gate 153), the return of the money box gate to closed position is via the time-delayed release of the latch 215 and the consequent time-delayed retraction of the lever 223. Thus, while the opening of the money box gate 155 occurs on rotation of the cam 129, which constitutes a control member for the gate, away from its retracted or home position through its forward stroke, the latch 215 functions as a means for holding the gate 155 open despite the return of the cam through its return stroke back to its retracted or home position for a time sufficient for dropout of all escrowed coins, and then releases gate 155 for its return to closed position. In effect, the return of gate 155 to its closed position is on a time basis independently of the cam 129. The latter, in returning to its retracted or home position, simply permits the closing of the gate on a time basis on elapse of a predetermined time interval following its return.

A lever 299 pivoted at 287 along with lever 285 carries a magnet 301 controlling a Hall effect switch 303 interconnected with the microcomputer M as shown in FIG. 10. The spring 291 is interconnected between levers 285 and 299 and biases lever 299 to swing counterclockwise as viewed in FIG. 2 for its engagement with the knee of lever 179. The arrangement is such that when lever 179 is swung down by the coin return bar 175 for the return of coin from escrow, the Hall effect switch 303 signals the microcomputer M to erase the credit which had been established by the deposit of coin.

The microcomputer M, the two binary switch devices 49 and 51 and the two Hall effect switches 295 and 303 are mounted on a circuit board 305 which is mounted on the front face of the back plate 13 at its upper left. At 307 is indicated a sales totalizer which is generally used though not critical insofar as the present invention in concerned. At 309 is indicated the upper part of a slug chute for delivering slugs from the slug rejector used above the unit 1 via the coin return system to the coin cup of the vending machine.

Operation is as follows:

With the coin handling unit 1 in place on the side wall 25, latch L2 is held in its retracted position clear of lockout levers 137 and 139 by the lug 9 on the back of the back plate 13. The low price latch L1 is normally in its locking position wherein it is engageable by either lockout lever 137 or 139 as the latter is swung away from its FIG. 7 retracted position or pulling out any knob 65L or 65H. The high price latch L3 is normally held in its retracted position by the high price latch control means 7, being movable to its locking position in the path of levers 137 and 139 when a high price knob 65H is pulled out. The binary switch devices 49 and 51 are set for the desired two prices, i.e., the high price and the low price, at which the packs of cigarettes (or other items) are to be vended.

On insertion of a nickel in the coin slot of the vending machine (e.g., the National Vendors Model 222 machine such as shown in U.S. Pat. No. 2,952,384) in which the coin handling unit 1 is used, the nickel is delivered by a suitable coin selector and slug rejector unit (not shown) to the nickel chute NC. In dropping in this chute, it intercepts the beams of light from both the first LED 35 and the second LED 39. Sensors 37 and 41 thereupon jointly signal the microcomputer M to record a credit of 5¢. A dime dropping in chute DC intercepts the beam of light from the second LED 39 and sensor 41 thereupon signals the microcomputer to record a credit of 10¢. A quarter dropping in chute QC intercepts the beam of light from the first LED 35 and sensor 37 thereupon signals the microcomputer to record a credit of 25¢. The microcomputer totalizes the value of all coins passing through the coin chutes. If and when the total reaches the low price, the microcomputer turns transistor 53 on to energize the solenoid 55 to release the latch 93 for the first latch release member R1. If and when the total reaches the high price, the microcomputer turns transistor 57 on to energize the solenoid 59 to release the latch 103 for the second latch release member R2.

Upon release of the latch 93 for the first latch release member R1, and pulling out a low price pull knob 65L, cam 129 is rotated forward (clockwise) from its retracted or home position of FIG. 1, and swings lever 138 clockwise to drive the yoke or driving member 83 down to swing the latch release member R1 counterclockwise as viewed in FIG. 5 to retract the latch L1. Pulling out the knob rotates the lockout lever 137 or 139, as the case may be depending on whether an upper knob 65L or a lower knob 65L is pulled out, toward the latch L1, but the latch L1 is quickly retracted in the initial phase of rotation of the cam and the lockout lever before it is engaged by the lockout lever. Accordingly, the knob 65L may be pulled out through a full stroke for a vend of a low price item.

Upon release of the latch 103 for the second latch release member R2, in addition to the release of the latch 93 for the first latch release member R1, and pulling out a high price knob 65H, cam 129 is similarly rotated forward and again via lever 138 drives the yoke 83 down to swing both latch release members R1 and R2 counterclockwise as viewed in FIG. 5 to retract the latches L1 and L3, the latter having come into its locking position on pulling out the high price knob. Accordingly, the knob may be pulled out through a full stroke for a vend of the high price item.

Upon either a low price or high price vend, as the cam 129 rotates forward, it swings the lever 285 up to cause the Hall effect switch 295 to signal the microcomputer M to cancel the credit.

Also, upon either a low price or a high price vend, as the cam 129 rotates forward away from its retracted or home position of FIG. 1, it swings the lever 223 counterclockwise away from its retracted position of FIG. 1 to an advanced position against the return bias of spring 237. As the lever 223 swings from its FIG. 1 retracted position to the stated advanced position, it acts via its cam slot 227 to drive the pin 229 up thereby to swing the money box gate 155 open. It also releases the pin 241 on latch 205 for the coin return gate 153, and allows latch 205 to swing down to latch gate 153 in its closed position to lock it against being opened by the coin return bar 175 during the vend cycle. As the money box gate 155 swings open, it becomes latched in its open position by the latch 215, and pin 229 (now at the lower end of slot 227) acts to hold the lever 223 in its advanced position.

The cam 129 is rotated through its forward stroke from its retracted or home position of FIG. 1 to its advanced position about 45° around from its retracted position on the customer pulling out a knob (65L or 65H), and returns to its retracted position on return of the knob to its retracted position completing the vend cycle. On the return of the cam, lever 138 returns to its FIG. 1 retracted position and the yoke 83 is returned to its raised retracted position of FIG. 5, but lever 223 is allowed to remain in its advanced position until the transistor 297 is turned on to energize solenoid 219 on a signal from the microcomputer at the end of the predetermined time delay interval (e.g., ½ second). Solenoid 219, on being energized, retracts the latch 215 and this allows lever 223 to swing back to its retracted position of FIG. 1 under the bias of spring 237 and thereby to drive pin 229 to close the gate 155. As above noted, this time delay interval is sufficient to allow for dropout of all coins from escrow to the money box. Also on return of cam 129, lever 285 returns to its FIG. 2 retracted position to reset switch 295, and pin 241 is raised to retract the latch 205 for the coin return gate 153.

For return of coin from escrow without a vend, the customer pushes the coin return knob of the vending machine to drive down the bar 175. This swings lever 179 counterclockwise as viewed in FIG. 2, and pin 195 on lever 179 swings lever 183 clockwise to retract the pin 187 from the coin return gate 153, allowing the latter to open (latch 205 being in retracted position at this time) for dropout of escrowed coin to the coin return system of the vending machine. And on the counterclockwise swing of lever 179, lever 299 swings counterclockwise to cause the Hall effect switch 303 to signal the microcomputer M to cancel the credit which had been established by the deposit of coin.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. For use in a coin-controlled vending machine which has first and second dispensing members manually operable by purchasers to obtain items of a first and a second price, respectively, means for locking said dispensing members against operation to obtain any item comprising a first latch and a second latch, each of said latches being movable between a locking position and a retracted position permitting operation of a dispensing member, the first latch normally occupying its locking position and the second normally occupying its retracted position and being movable to its locking position on operation of a second dispensing member, coin apparatus for controlling said latches comprising:

a first latch release member for releasing said first latch;

a second latch release member for releasing the second latch;

coin chute means for coins of different denominations;

logic means for totalizing the value of coins passing through the chute means;

means for storing data as to said first and second prices at which items are to be vended;

means controlled by the logic means for operating the first latch release member upon the totalized value reaching the first stored price and operation of a first dispensing member, thereby to effect release of said first latch, and for operating both latch release members upon the totalized value reaching the second stored price and operation of a second dispensing member, thereby to effect release of said first and second latches;

each latch release member being movable away from a retracted position for releasing the resective latch and being biased to its retracted position; and the means controlled by the logic means comprising:

first solenoid-operated means for holding the first latch release member against latch-releasing movement;

second solenoid-operated means for holding the second latch release member against latch-releasing movement; and means operable on manual operation of a first dispensing member for moving the first latch release member, upon its release, away from its retracted position for releasing the first latch and operable on manual operation of a second dispensing member for moving both latch release members, upon their release, away from their retracted position for releasing both latches.

2. Coin apparatus as set forth in claim 1 wherein the means for moving the latch release members comprises a single driving member for both latch release members movable away from and back to a retracted position in response to operation and return of any dispensing member, and spring means interconnecting said driving member with said match release members enabling driving of the first latch release member while the second remains held against latch-releasing movement.

3. Coin apparatus as set forth in claim 2 having a mechanism plate with the latch release members pivoted on the plate on one face of the plate constituting its front, each latch release member having a projection engageable with the respective latch through an opening in the plate, the spring means biasing the latch release members to a retracted position wherein their projections are withdrawn through the openings, each solenoid-operated means comprising a solenoid and latch means controlled by the solenoid engageable with the respective latch release member for holding it in its retracted position and disengageable therefrom on energization of the solenoid to release the latch release member for movement of its projection through the respective opening to release the respective latch.

4. Coin apparatus as set forth in claim 3 for a vending machine which has a third latch movable between a locking position for said dispensing members and a retracted position, having means on the back of said plate for holding said third latch in retracted position.

5. Coin apparatus as set forth in claim 1 wherein said means for storing data as to said first and second prices comprises first switch means for setting the first price and second switch means for setting the second price, said switch means being interconnected with said logic means, the solenoid of said first solenoid-operated means being energized in response to the totalized value reaching the first price as set by the first switch means and the solenoid of said second solenoid-operated means being energized in response to the totalized value reaching the second price as set by the second switch means.

6. For use in a coin-controlled vending machine which has first and second dispensing members manually operable by purchasers to obtain items of a first and second price, respectively, means for locking said dispensing members against operation to obtain any item comprising a first latch and a second latch, each of said latches being movable between a locking position and a retracted position permitting operation of a dispensing member, the first latch normally occupying its locking position and the second normally occupying its retracted position and being movable to its locking position on operation of a second dispensing member, coin apparatus for controlling said latches comprising:

a first latch release member for releasing said first latch;

a second latch release member for releasing the second latch;

coin chute means for coins of different denominations;

logic means for totalizing the value of coins passing through the chute means;

means for storing data as to said first and second prices at which items are to be vended;

means controlled by the logic means for operating the first latch release member upon the totalized value reaching the first stored price and operation of a first dispensing member, thereby to effect release of said first latch, and for operating both latch release members upon the totalized value reaching the second stored price and operation of a second dispensing member, thereby to effect release of said first and second latches;

the chute means comprising first, second and third chutes for coins of a first, a second and a third demination, said chutes being located in side-by-side relation, first means for projecting a first beam of light across the first and third chutes, a first sensor for sensing said first beam, and connected to the logic means, second means for projecting a second beam of light across the first and second chutes, and a second sensor for sensing said second beam and connected to the logic means, a coin of the first denomination passing through the first chute intercepting both beams to cause the first and second sensors to signal the logic means the passage of a coin of the first denomination, a coin of the second denomination passing through the second chute intercepting the second beam to cause the second sensor to signal the logic means the passage of a coin of the second denomination, and a coin of the third denomination passing through the third chute intercepting the first beam to cause the first sensor to signal the logic means the passage of a coin of the third denomination.

7. Coin apparatus as set forth in claim 6 wherein the first chute is for a nickel chute, the second a dime chute and the third a quarter chute.

8. For use in a coin-controlled vending machine which has first and second dispensing members manually operable by purchasers to obtain items of a first and a second price, respectively, means for locking said dispensing members against operation to obtain any item comprising a first latch and a second latch, each of said latches being movable between a locking position and a retracted position permitting operation of a dispensing member, the first latch normally occupying its locking position and the second normally occupying its retracted position and being movable to its locking position on operation of a second dispensing member, coin apparatus for controlling said latches comprising:

a first latch release member for releasing said first latch;

a second latch release member for releasing the second latch;

coin chute means for coins of different denominations;

logic means for totalizing the value of coins passing through the chute means;

means for storing data as to said first and second prices at which items are to be vended;

means controlled by the logic means for operating the first latch release member upon the totalized value reaching the first stored price and operation of a first dispensing member, thereby to effect release of said first latch, and for operating both latch release members upon the totalized value reaching the second stored price and operation of a second dispensing member, thereby to effect release of said first and second latches;

escrow means for escrowing coins deposited in the vending machine for return to a customer or for delivery to a money box, said escrow means comprising a first gate and a second gate each having a closed position for holding coins in escrow pending coin return or a vend, coin return means operable by a customer for opening the first gate for dropout of escrowed coins to a coin return passage for return to the customer without opening the second gate, means operable on a vend for opening the second gate for dropout of escrow coins to a money box passage for delivery of the coins to a money box without opening the first gate, said means operable on a vend comprising a control member movable away from and back to a retracted position on a vend, and means for holding the second gate open despite return of said control member to retracted position for a time sufficient for dropout of all escrowed coins and then releasing it for its return to closed position;

the means for holding the second gate open comprising a solenoid-operated latch means for latching the second gate in open position, the solenoid of said means being energized under control of the logic means upon elapse of a predetermined time interval following the return of said control member for the return of the second gate to its closed position on a time basis independently of said control member; and the chute means comprising first, second and third chutes for coins of a first, a second and a third denomination, said chutes being located in side-by-side relation, first means for projecting a first beam of light across the first and third chutes, a first sensor for sensing said first means, and a second sensor for sensing said second beam and connected to the logic means, a coin of the first denomination passing through the first chute intercepting both beams to cause the first and second sensors to signal the logic means the passage of a coin of the first denomination, a coin of the second denomination passing through the second chute intercepting the second beam to cause the second sensor to signal the logic means the passage of a coin of the second denomination, and a coin of the third denomination passing through the third chute intercepting the first beam to cause the first sensor to signal the logic means the passage of a coin of the third denomination.

9. Coin apparatus as set forth in claim 8 wherein the first chute is for a nickel chute, the second a dime chute and the third a quarter chute.

10. Coin apparatus comprising first, second and third chutes for coins of a first, a second and a third denomination, said chutes being located in side-by-side relation, first means for projecting a first beam of light across the first and third chutes, a first sensor for sensing said first beam, second means for projecting a second beam of light across the first and second chutes, and a second sensor for sensing said second beam, a coin of the first denomination passing through the first chute intercepting both beams to cause the first and second sensors to signal the passage of a coin of the first denomination, a coin of the second denomination passing through the second chute intercepting the second beam to cause the second sensor to signal the passage of a coin of the second denomination, and a coin of the third denomination passing through the third chute intercepting the first beam to cause the first sensor to signal the passage of a coin of the third denomination.

11. Coin apparatus as set forth in claim 10 wherein the first chute is for a nickel chute, the second a dime chute and the third a quarter chute.

* * * * *